United States Patent [19]

Bonner

[11] 3,974,540

[45] Aug. 17, 1976

[54] RIBBON CLEANING AND SCANNING APPARATUS

[76] Inventor: William J. Bonner, 1416 Nancy Drive, South Hampton, Pa. 19066

[22] Filed: Aug. 6, 1975

[21] Appl. No.: 602,160

[52] U.S. Cl. ..... 15/306 A; 15/324; 15/339; 197/172

[51] Int. Cl.[2] ..... A47L 5/38

[58] Field of Search ..... 15/306 R, 306 A, 324, 15/339; 101/425; 197/172; 240/2 VC, 2.18

[56] References Cited

UNITED STATES PATENTS

| | | | |
|---|---|---|---|
| 2,677,461 | 5/1954 | Bodey | 15/339 X |
| 2,832,985 | 5/1958 | Durling | 15/324 X |
| 2,956,300 | 10/1960 | Bruno | 15/306 A |
| 2,956,301 | 10/1960 | Bruno | 15/306 A |
| 3,078,496 | 2/1963 | Doran et al. | 15/306 A X |
| 3,270,397 | 9/1966 | Ingham, Jr. et al. | 15/306 A X |

*Primary Examiner*—Billy J. Wilhite
*Assistant Examiner*—C. K. Moore
*Attorney, Agent, or Firm*—Fitch, Even, Tabin & Luedeka

[57] ABSTRACT

An apparatus for scanning and cleaning computer printout ribbons is provided with an electromagnetic clutch drive which facilitates connection and reversal of direction of the motor drives for transporting the ribbon in a forward or reverse direction of travel. This increases the production rate of the apparatus. Also, a magnetic means is provided to remove metal particles from the ribbon in combination with a vacuum means which uses suction to clean lint, dirt and other foreign matter from the ribbon as it travels from a supply chuck means to a take up chuck means.

5 Claims, 4 Drawing Figures

11
12
18
19
23
27
29
31
41
45
47
48
50
51
53
58
59
63
64
65
67
69
71
73
74
75
78
79
80
81
83
84
85
87
89
90
91
93
98
99
101
103
105
107
109
111

20
23
31
32
33
35
37
39
47
48
51
53
55
57
59
60
61
95
97
112
113
115
120
121
25
14
15
16

RIBBON CLEANING AND SCANNING APPARATUS

This invention relates to a cleaning and scanning apparatus for scanning and cleaning printer ribbons used by computer printout machines.

Computer printer ribbons are usually 14 to 17 inches in width and about 20 yards in length having each end attached to a winding core by staples. In the computer printout machines, the ribbon travels between its respective cores and reversing bars attached to the ribbons adjacent their ends to operate mechanisms to reverse the direction of ribbon travel and to reverse the winding and unwinding on the respective cores. The majority of such computer ribbons are made of thermoplastic material such as woven nylon and are about 5 mils in thickness although some ribbons are made of 3 mil nonwoven Mylar. Typically, such computer ribbons are used for hundreds of thousands of lines of printout before the printout becomes too light for further usage of the ribbon.

Because these computer ribbons are relatively expensive, it is the practice of many in the industry to re-ink these computer ribbons at least once after their initial usage. Prior to re-inking, the computer ribbon is visually inspected by the operator and at the same time it is cleaned to remove lint, dust, old ink, and other foreign material. The ribbons are visually inspected for holes or tears in the fabric caused by the pounding received during the initial use of the ribbon. Such holes will interfere with the continued usage of the ribbon after re-inking. The quality of the woven fabric are also studied to make sure that the fabric is in sufficiently good condition to withstand another long hard usage after being re-inked.

For most commercially successful re-inking operations, hundreds of ribbons are re-inked daily by the re-inking apparatus and each ribbon be cleaned and inspected prior to re-inking. Thus, labor and time involved in a ribbon cleaning and inspection operation is preferably reduced to a minimum. While ribbon cleaning and scanning apparatus of the foregoing kind have been used for such inspection and cleaning of ribbons, the manipulations required to operate the apparatus, particularly to stop or reverse direction of ribbon travel in order to allow the operator to examine the ribbon more closely before making a decision as to whether or not the ribbon is of sufficient quality to be re-inked, have interfered with fast and efficient operation of the apparatus.

Accordingly, an object of the present invention is to provide an improved cleaning and scanning apparatus of the foregoing kind.

Other objects and advantages will become apparent from the following detailed description taken in connection with the accompanying drawings in which.

Figure 1:
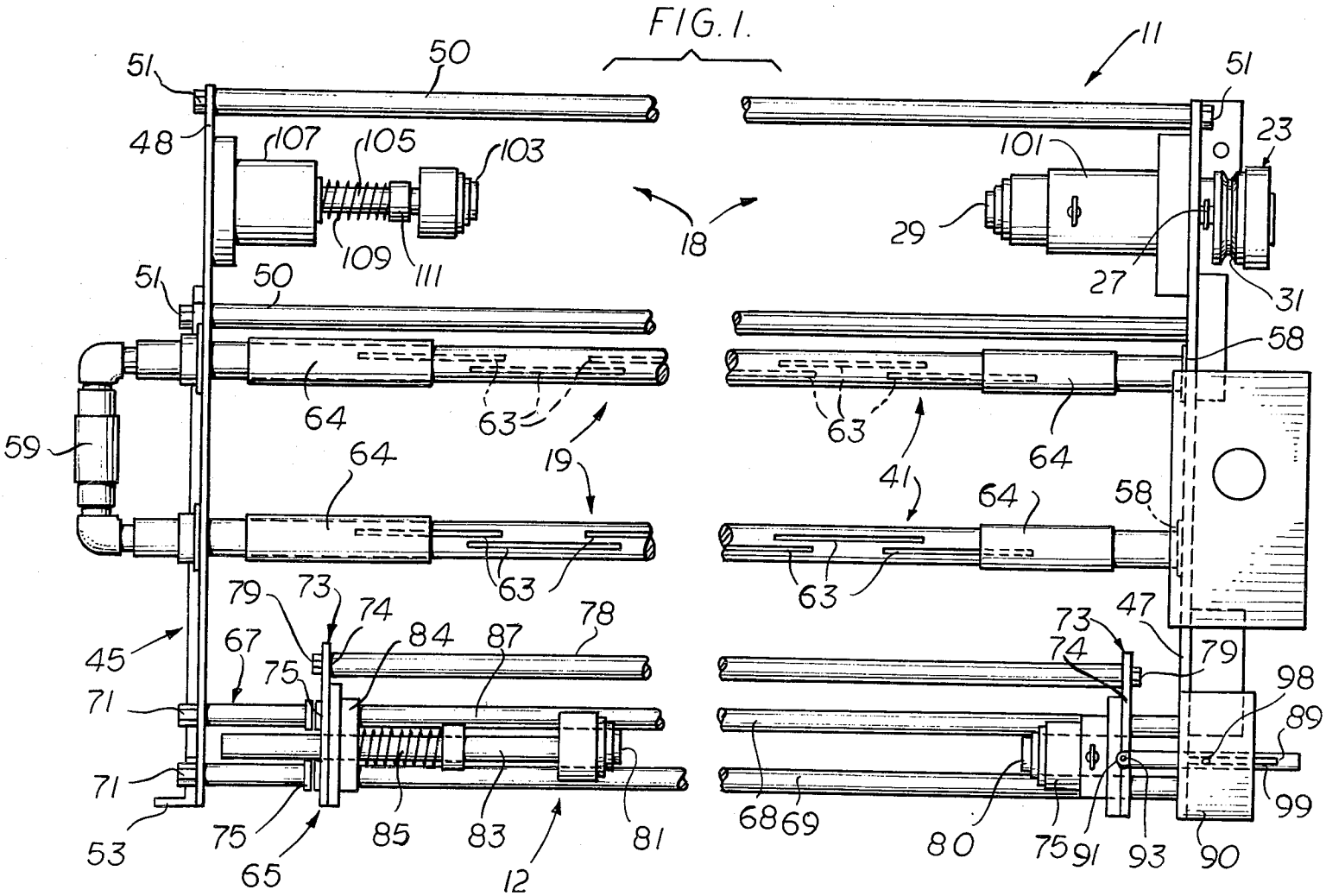
FIG. 1 is a front elevational view of ribbon scanning and cleaning apparatus embodying the novel features of the invention.
Figures 2, 3, 4:
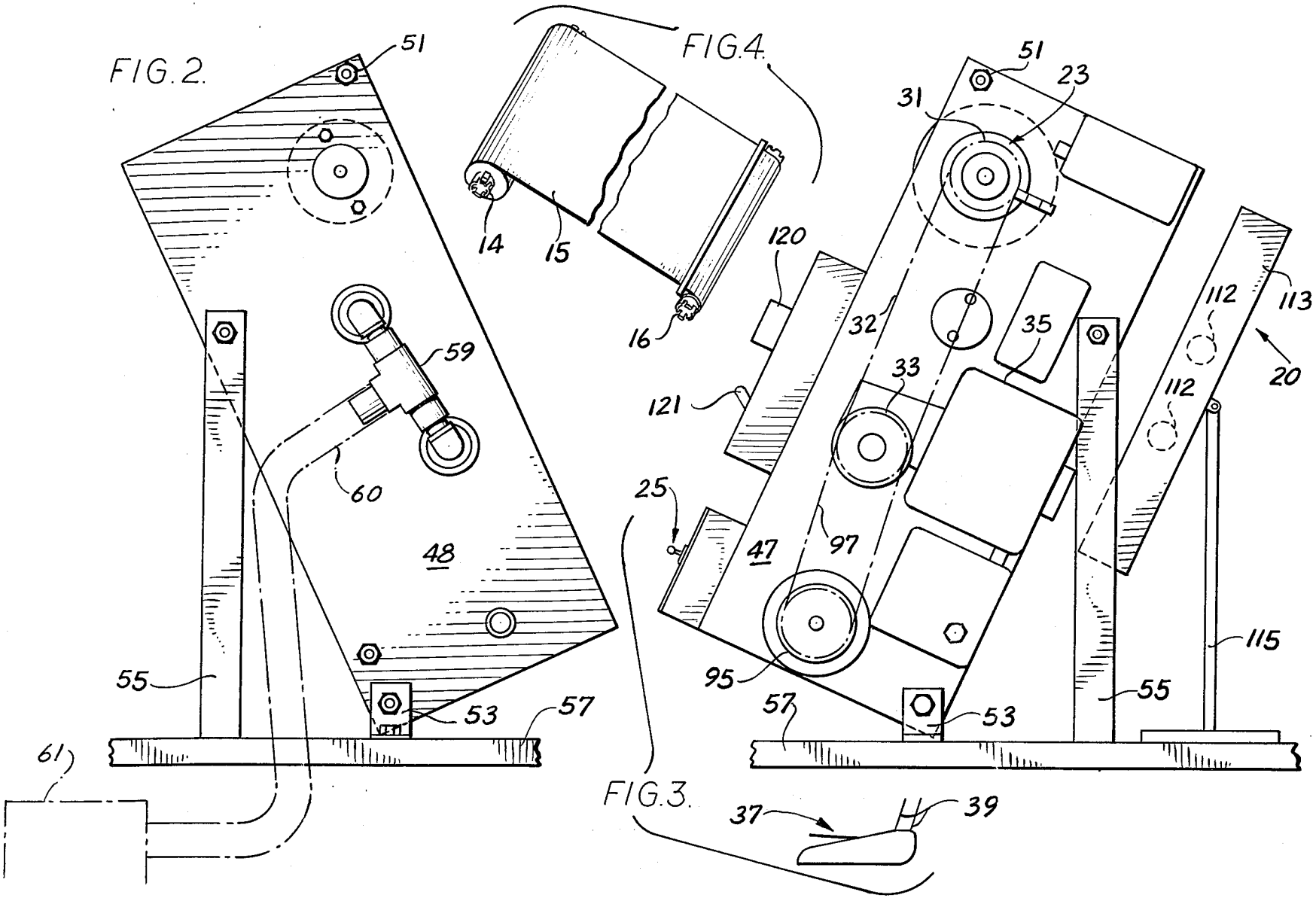
FIG. 2 is an end view of the apparatus of FIG. 1.
FIG. 3 is an opposite end view of the apparatus of FIG. 1.
FIG. 4 is a perspective view of a ribbon for cleaning and scanning by the apparatus of FIG. 1.

As shown in the drawings for purposes of illustration, the invention is embodied in a ribbon cleaning and scanning apparatus 11 which is provided with a first ribbon support or chuck means 12 for receiving a supply core 14 of a computer ribbon 15 having another core 16 which is mounted and supported by a supporting means in the form of a take up chuck means 18. The take up chuck means 18 is motor driven to unwind the ribbon from the supply core 14 for travel past a vacuum means 19 which removes lint, dirt and other foreign material by suction from the ribbon as it travels between the supply core 14 and the take up core 16. During the course of ribbon travel past the vacuum means 19, the operator views the wide width of the traveling ribbon and observes holes or tears or other defects in the ribbon fabric as detected by increased light shining through such tears or openings from a light source 20 positioned behind the ribbon.

In accordance with the present invention, the speed and simplicity of operation of such a ribbon cleaning and scanning apparatus is increased by providing an electricallycontrolled clutch 23 which is used to engage the motor drive of the take up chuck means 18 upon the operation of a control switch means 25 for the clutch 23. More specifically, the electromagnetic clutch 23 is mounted on the end of a drive shaft 27 for the rotatable drive mandrel 29 of the take up chuck means 18 with the input side of the clutch 23 carrying a pulley 31 which is driven by a belt 32 extending to and driven by a double drive sheave 33 connected to and driven by a motor 35. The motor 35 is an electric motor which is energized by a foot control pedal 37 having a pair of leads 39 leading from the foot pedal to the motor 35 so that the operator may control the motor while having both hands free during the winding operation.

While heretofore vacuum bars 19 have been used for removal of dirt or lint from the webs, metal particles are not always removed by such; and, with the present invention, a magnetic means 41 is provided in association with the vacuum means to assist in cleaning the ribbon by removing metal particles from the ribbon. The preferred magnetic means 41 is obtained by magnetizing each of the vacuum bars 19 so that the particles adhere magnetically to the bar 19 when traveling thereacross. The magnetized bar may be wiped periodically to remove the particles from the bar.

Referring now in greater detail to the illustrated embodiment of the invention, the apparatus 11 comprises a frame means 45 which includes a pair of opposite vertical side plates 47 and 48 of generally rectangular shape held together and spanned by a series of upper and lower support and spacing bars 50 which are secured by fasteners such as nuts 51 to the side plates. Herein, the side plates 47 are disposed at an oblique angle to the vertical and may be mounted by suitable upstanding brackets 53 and 55 to a suitable horizontal base such as a tabletop 57.

The preferred vacuum bars 19 are formed of hollow circular bars having first ends sealed by end caps 58 which are secured to and mounted on the side frame plates 47. The opposite ends of the vacuum bars extend through openings in the frame plate 48 with their hollow interiors connected to a common T-shaped header pipe 59 which is connected by a pipe 60 to a vacuum pump 61. A plurality of longitudinally extending slots 63 are provided in each of the vacuum bars 19 for withdrawing ambient air and creating a suction force to hold the ribbons to the bars and to act as a suction device to remove lint and dust from the ribbon surface. A pair of short cylindrically shaped sleeves 64 are slidably mounted on each of the bars 19 to be positioned to cover portions of the slots 63, if desired.

For the purpose of providing a more uniformly wound roll on the take up core 16, the lower chuck means 12 is mounted on a traveling carriage 65 which the operator manually shifts slightly on a guide track or guide bar means 67 to maintain the ribbon edges on the roll being formed on the take up core 16 to reduce the conical build up of the ribbon ends of the ribbon roll being formed on the take up core. The preferred guide bar means 67 comprises a pair of smooth surfaced, horizontally extending guide rods 68 and 69 secured at opposite ends by fasteners 71 to the respective side frame plates 47 and 48 near the lower ends thereof.

The carriage 65 for the chuck means 12 includes a pair of spaced upstanding mounts 73 comprising a pair of ball bushes 75 mounted for sliding on the guide rods 68 and 69 and flat, vertically extending, carriage side plates 74 to which the ball bushes are secured. The upper outer ends of each of the carriage side plates 74 are secured to and spanned by a stabilizing bar 78 which extends horizontally and which is fastened by fasteners 79 at its opposite ends to the carriage side plates 74.

The supply chuck means 18 on the carriage 65 includes a step driving mandrel 80 for entering into right end of the hollow end of the supply core 14 and a stepped follower mandrel 81 for entering into the hollow left end of the core 14. The step follower mandrel 81 includes a horizontally extending mounting shaft 83 which extends through and is supported for rotation in a bearing 84 fixed to an upstanding carriage side plate 74. The mandrel 81 is mounted to rotate about the longitudinal axis of the shaft 83. A coiled spring 85 encircles the support shaft 83 and is positioned between a collar 87 fastened to the shaft and the bearing 84 to bias the follower mandrel 81 and, when a core is positioned therein, to force the core 14 to the right and to maintain it under axial pressure between the mandrels 80 and 81. When installing a core 14, the collar 87 and the shaft 83 are shifted to the left and the spring 85 is compressed and the core is positioned in line with the mandrels 80 and 81; and then the mandrel 81 is released with the spring 85 expanding and forcing the follower mandrel 81 to push the core to the right and further onto the mandrel 80.

The driving mandrel 80 of the supply chuck means 12 is mounted for rotation in a bearing mount 90 secured to the righthand carriage plate 73. In this instance, a driving shaft 89 mounted for rotation in a bearing 90 fastened to the side plate 47 is manually clutched to the mandrel 80 by the operator when it is desired to reverse the direction of travel of the ribbon. To this end, a clutch means is provided comprising a radially projecting pin 91 secured to the inner end of the shaft 89 for insertion into a radially extending slot 93 in the righthand end of the mandrel 80 to rotate the same. To unclutch the mandrel 80 from the shaft 89, the shaft 89 is shifted axially to the left to remove the pin 91 from the slot 93 on the mandrel 80 thereby uncoupling the latter from turning shaft 89. A sheave 95 is fixed to the shaft 89 and is driven by a belt 97 extending to the double sheave 33 driven by the motor drive 35. The sheave 95 carries an internal ball 98 which is inserted into a longitudinally extending slot 99 formed in the shaft 89 to allow axial movement of the shaft 89 relative to the sheave 95 with the drive therebetween being maintained.

When the ribbon 15 is to be wound on the supply core 14, the operator merely throws the switch 25 to declutch the electrical clutch means 23 so that the drive chuck means 18 is rendered inoperative, i.e., non-driving; and the operator pushes the end of the shaft 89 to the left to insert a driving pin 91 thereon into the bayonet-like slot 93 in the mandrel 80 allowing the pin and shaft to turn the mandrel 80 in the reverse direction. After the motor 35 is de-energized by the foot switch 37, the shaft 81 is turned slightly in the reverse direction within the bayonet slot in the mandrel 80 and then the pin 91 is pulled axially to the right to shift it from the slot 93 whereby the mandrel 80 is declutched from the drive sheave 95. The switch 25 may again be operated to actuate electrical clutch 23 to connect the take up mandrel 29 to the motor drive to drive the ribbon forwardly.

The shaft 27 is journaled for rotation in a bearing mount 101 fixed to the upper interior side of the side frame plate 47 for rotation about a generally horizontal axis. Aligned with the same horizontal axis at the other side of the apparatus is a stepped follower mandrel 103 for the take up chuck means 18. The stepped mandrel 103 is secured to the end of a horizontally extending shaft 105 mounted for rotation in a bearing mount 107 fastened to the upper interior side of frame side plate 48. The stepped mandrel 103 is urged to the right, as shown in the drawings, by means of a coiled compression spring 109 encircling the shaft 105 and disposed between the bearing mount 107 and a collar 111 fixed to the shaft. The shaft 105 and the stepped mandrel 103 may be pushed to the left when inserting the take up core 16; and, when the core has been positioned, the operator releases the mandrel 103 which is then shifted to the right by the compressed spring 109.

The light source 20 for illuminating the ribbon being cleaned may be in the form of a commercially available fluorescent lamp having a pair of fluorescent lights 112 mounted in a suitable cover 113 pivotally or connected by a swivel to a vertically extending stand 115 positioned or secured at its lower end to the table 57. Alternatively, the light source may be attached to the side frame plates 47 and 48.

A brief description of the operation of the cleaning and scanning apparatus will be given as an aid to an understanding thereof. The operator inserts the take up core 16 into the take up chuck means 18 by shifting a stepped mandrel 103 and its support shaft 105 to the left as viewed in the drawings compressing the spring 109. The righthand end of hollow take up core 16 is telescoped on the stepped mandrel 29 and the left-hand end of the core is positioned on the stepped mandrel 103. The mandrel is released allowing the spring 109 to expand to hold the take up core in position for winding.

The ribbon 15 is then laid across and beneath the top vacuum bar 19 and then threaded between the bars 19 to the upper side of the lower vacuum bar 19 so that both sides of ribbon are cleaned. The follower mandrel 81 is pushed to the left, as viewed in these figures, to allow the telescoping of the hollow righthand end of the supply core 14 onto the stepped mandrel 80. The follower mandrel 81 is then telescoped into the left hollow end of the core 14 and the mandrel is released to allow the spring 85 to expand.

With the cores 14 and 16 mounted on the respective chuck means, the operator will then depress the foot switch 37 to energize and operate the electric motor 35 to turn the sheave 33 and thereby drive the belts 32 and 97. The belt 32 drives the sheave 31 and through the magnetic clutch 23, which is energized by operation of the switch 25, drives the shaft 27 to turn the stepped take up mandrel 28. The speed of the motor 35 and rotation of the take up mandrel is controlled through the variable motor control switch means including a turnable control knob 120. A second switch means 121 controls the direction of rotation of the motor. The operator watches the traveling ribbon 15 for any pinholes or other defects in the ribbon fabric as it travels over the vacuum bars 19. The suction device 61 will be collecting lint or material entering the bars through the slots 63 in these vacuum bars. If a defect is noted, the operator will release the foot pedal which opens a switch in the circuit of the motor 35 thereby stopping the drive of the sheave 33 and the take up mandrel 29. Usually, the area of the defect desired to be examined will have passed onto the take up roll so that the operator will throw the switch 25 to its opposite position to open the magnetic clutch 23. The operator will slide the shaft 89 leftwardly, as viewed in these figures, to shift the pin 91 into a slot 93 thereby clutching the supply mandrel 80 to the shaft 89 for rotation therewith. The operator then flips the switch means 121 to reverse the direction of rotation of the motor 35 and depresses the foot pedal 27 to turn the motor 35 which again turns the sheave 33 with the upper sheave 31 turning while the shaft 27 remains stationary because the clutch 23 is in its open position. The preferred electromagnetic clutch 23 is commercially available and sold by Stearns under the trademark "Magnetic Rotosheave". The motor 35 drives lower sheave 95 which acts through the ball 98 in the slot 99 of the shaft 89 to turn the shaft and to turn the stepped supply mandrel 80 in the reverse direction to wind ribbon onto the core 14. The operator slows the ribbon travel speed for reverse direction travel by turning the variable speed control knob 120. At the point of the defect, the operator will release the foot pedal to stop the motor and examine the ribbon in detail and make a judgement as to the quality of the ribbon.

After making the examination, the operator shifts the shaft 89 to the right to disengage the pin 91 from the slot 93 declutching the supply mandrel 80 from the rotating shaft 89. By flipping the switch means 121 to reverse the direction of motor rotation and by flipping the switch 25 to the other position, the magnetic clutch 23 is energized and rotated to cause a continued winding of the ribbon onto the take up chuck means 18. The magnetized vacuum bars 19 will attract and hold metal particles found on the ribbon.

From the foregoing, it will be seen there is provided a simple and quick operation for the cleaning of a ribbon. A second magnetic clutch may be used to clutch the reverse driving mandrel 80 to the drive shaft 95 in the manner that the magnetic clutch 23 is used to clutch the drive for the shaft 27 for the take up mandrel 29. The magnetized bar 19 aids in removing metal particles.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A cleaning and scanning apparatus for cleaning and scanning ribbons having one end attached to a supply core and an opposite end connected to a take up core, said apparatus comprising: a frame means, a supply chuck means supported by said frame means for mounting the supply core for rotation about a first axis, a take up chuck means mounted on said frame means and spaced from said supply chuck means for receiving and supporting the take up core, a vacuum means extending across the ribbon for applying suction to the ribbon to clean the ribbon of foreign material thereon, a light source located behind the ribbon for allowing the operator to view the ribbon and to spot a hole, tears or defects in the ribbon, a motor drive means for driving the take up chuck means in a forward direction and for driving the ribbon in a forward direction and for selectively driving a supply chuck means in the opposite direction to reverse the direction of the ribbon travel, and at least one electromagnetic clutch means operable to clutch or unclutch the driving of one of said chuck means by said motor means.

2. An apparatus in accordance with claim 1 in which an electrical switch means is provided for operating said electromagnetic clutch means to stop and to start the turning movement of one of said chuck means.

3. An apparatus in accordance with claim 2 in which said electromagnetic clutch means is connected to said take up chuck means.

4. An apparatus in accordance with claim 1 in which said electromagnetic clutch means comprises a first electromagnetic clutch for selectively driving said take up chuck means and a second electromagnetic clutch for selectively driving said supply chuck means.

5. A cleaning and scanning apparatus for cleaning and scanning ribbons having one end attached to a supply core and an opposite end connected to a take up core, said apparatus comprising: a frame means, a supply chuck means supported by said frame means for mounting the supply core for rotation about a first axis, a take up chuck means mounted on said frame means and spaced from said supply chuck means for receiving and supporting the take up core, a vacuum means extending across the ribbon for applying suction to the ribbon to clean the ribbon of foreign material thereon, a light source located behind the ribbon for allowing the operator to view the ribbon and to spot a hole, tears or defects in the ribbon, a motor drive means for driving the take up chuck means in a forward direction and for driving the ribbon in a forward direction and for selectively driving a supply chuck means in the opposite direction to reverse the direction of the ribbon travel, and magnetic means for attracting magnetizable metal from the ribbon to remove the same during the cleaning operation by magnetic attraction.

* * * * *